US007909528B2

(12) United States Patent
Brooks et al.

(10) Patent No.: US 7,909,528 B2
(45) **Date of Patent: *Mar. 22, 2011**

(54) SUPPORT FOR COATING INSTRUMENT

(75) Inventors: Matthew L. Brooks, Falls Church, VA (US); Daniel Silverman, Arlington, VA (US)

(73) Assignee: UpWrite, LLC, Creve Coeur, MO (US)

( * ) Notice: Subject to any disclaimer, the term of this patent is extended or adjusted under 35 U.S.C. 154(b) by 781 days.

This patent is subject to a terminal disclaimer.

(21) Appl. No.: 11/852,448

(22) Filed: Sep. 10, 2007
(Under 37 CFR 1.47)

(65) Prior Publication Data

US 2008/0101846 A1 May 1, 2008

Related U.S. Application Data

(63) Continuation-in-part of application No. 10/860,246, filed on Jun. 3, 2004, now Pat. No. 7,267,504.

(51) Int. Cl.
*B43K 23/02* (2006.01)
*B43K 29/00* (2006.01)

(52) U.S. Cl. ..... 401/131; 401/195

(58) Field of Classification Search ..... 401/48, 401/52, 131, 195; 24/11 C, 11 CC, 11 F, 24/11 M See application file for complete search history.

(56) References Cited

U.S. PATENT DOCUMENTS

| | | | | |
|---|---|---|---|---|
| 276,512 | A | | 4/1883 | Webster |
| 454,064 | A | | 6/1891 | Pfeiffer |
| 575,458 | A | | 1/1897 | Canfield |
| 1,404,863 | A | | 1/1922 | Klenck |
| 1,818,081 | A | | 8/1931 | Mingos |
| 1,840,191 | A | | 1/1932 | Eubanks |
| 2,568,907 | A | | 9/1951 | Bernstein |
| 3,425,779 | A | | 2/1969 | Fisher et al. |
| 3,846,927 | A | * | 11/1974 | Geffen ..... 40/334 |
| 3,972,628 | A | | 8/1976 | Stevers |
| 4,020,978 | A | | 5/1977 | Szczepanski |
| 4,149,812 | A | | 4/1979 | Huffman, Jr. |
| 4,285,101 | A | * | 8/1981 | Hanna ..... 24/3.12 |
| 4,516,869 | A | | 5/1985 | Corpataux |
| 4,865,285 | A | | 9/1989 | Gaggianese |
| D305,777 | S | | 1/1990 | Lee |
| 4,896,983 | A | | 1/1990 | Im et al. |
| 4,917,517 | A | | 4/1990 | Ertz |
| 4,944,624 | A | | 7/1990 | Garland |
| D316,274 | S | | 4/1991 | Suzuki |
| 5,033,629 | A | | 7/1991 | Caine |
| 5,037,224 | A | | 8/1991 | Wright |
| 5,085,351 | A | | 2/1992 | Martin |

(Continued)

FOREIGN PATENT DOCUMENTS

EP 0336168 A1 10/1989

(Continued)

*Primary Examiner* — David J Walczak
(74) *Attorney, Agent, or Firm* — Hayworth, Chaney & Thomas, P.A.; Robert A. Lynch; Stephen C. Thomas

(57) ABSTRACT

A support for a coating instrument includes an advertising image. The support is movable between a non-extended position and an extended position in which the support projects outward away from the shaft for contact with a surface on which the instrument is placed. The advertising image may be formed on a substrate that is adhered on an outer surface of the support. Alternatively, the support may be configured as a three-dimensional image.

20 Claims, 15 Drawing Sheets

U.S. PATENT DOCUMENTS

| | | | | |
|---|---|---|---|---|
| 5,352,053 | A | | 10/1994 | Reitze |
| 5,454,654 | A | | 10/1995 | Bergström |
| D369,184 | S | | 4/1996 | Collins |
| 5,641,232 | A | | 6/1997 | Frey |
| 5,649,645 | A | | 7/1997 | Demarest et al. |
| 5,651,626 | A | | 7/1997 | Chen |
| 5,823,494 | A | | 10/1998 | Jones et al. |
| 5,839,712 | A | | 11/1998 | Wang |
| 5,915,807 | A | | 6/1999 | Ilagan |
| 6,045,281 | A | * | 4/2000 | Bunn et al. ..... 401/195 |
| 6,129,470 | A | * | 10/2000 | Fang ..... 401/52 |
| 6,247,865 | B1 | | 6/2001 | Russell |
| 6,283,335 | B1 | | 9/2001 | Young et al. |
| 6,467,980 | B1 | | 10/2002 | Krause |
| 6,471,432 | B1 | | 10/2002 | Kremer |
| 6,488,429 | B2 | | 12/2002 | Korper |
| D475,088 | S | | 5/2003 | Cetera |
| 6,592,279 | B1 | | 7/2003 | Kagel |
| 6,626,334 | B2 | | 9/2003 | Ewing |
| 6,659,314 | B2 | | 12/2003 | Garcia |
| 6,685,374 | B1 | | 2/2004 | Cetera |
| D495,003 | S | | 8/2004 | Cetera |
| D495,364 | S | | 8/2004 | Cetera |
| D517,330 | S | | 3/2006 | Cetera |
| 7,018,123 | B1 | | 3/2006 | Cetera |
| D521,556 | S | | 5/2006 | Cetera |
| D526,020 | S | | 8/2006 | Cetera |
| 7,086,798 | B1 | | 8/2006 | Cetera |
| 7,156,570 | B2 | | 1/2007 | Cetera |
| D536,733 | S | | 2/2007 | Cetera |
| D549,778 | S | | 8/2007 | Kent |
| 7,267,504 | B2 | | 9/2007 | Brooks |
| 2006/0143874 | A1 | | 7/2006 | Cetera |
| 2006/0147245 | A1 | | 7/2006 | Cetera |
| 2006/0222449 | A1 | | 10/2006 | Cetera |
| 2006/0228162 | A1 | | 10/2006 | Cetera |

FOREIGN PATENT DOCUMENTS

| | | | |
|---|---|---|---|
| EP | 1057536 | A2 | 12/2000 |
| FR | 891496 | A | 3/1994 |
| WO | WO 01/98178 | A1 | 12/2001 |
| WO | 2007135637 | A2 | 11/2007 |

* cited by examiner 110
109
108
118
115
116
112
101

122
119
120
126
123
129
130
132

SUPPORT FOR COATING INSTRUMENT

CROSS-REFERENCE TO RELATED APPLICATION

The present application is a continuation-in-part of U.S. patent application Ser. No. 10/860,246, filed Jun. 3, 2004, which has now become U.S. Pat. No. 7,267,504, the entirety of which is herein incorporated by reference.

FIELD OF THE INVENTION

The present invention generally relates to a coating instrument including a support with an advertising image.

BACKGROUND OF THE INVENTION

Broadly, a coating instrument is used to apply a layer of material onto a substrate. The coating instrument may be, for example, a pen for coating paper with ink, or a pencil for coating paper with graphite, or medical instrument for coating an area of a patient's skin with a medication. A disadvantage of traditional coating instruments is that many are not easily grasped by a user when the instrument is lying on a horizontal surface. This is especially true for users that are handicapped or are required to wear surgical gloves or the like with both user-types having impaired dexterity preventing easy manipulation (e.g. picking up) of the instrument in its horizontal resting position.

SUMMARY OF THE INVENTION

In one aspect of the present invention, a coating instrument generally comprises a shaft having opposite front and rear ends and a coating tip adjacent to the front end of the shaft. A support is securable and movable with respect to the shaft from a non-extended position to an extended position in which the support projects outward away from the shaft for contact with a surface on which the instrument is placed thereby to support the shaft in a position in which a portion of the shaft is spaced away from the surface. An advertising image on the support faces outward away from the shaft when the support is in said non-extended position.

In another aspect, a fluid dispensing instrument generally comprises a shaft having opposite front and rear ends and a dispensing tip adjacent to the front end of the shaft. A support is securable to and movable with respect to the shaft from a non-extended position to an extended position in which the support projects outward away from the shaft for contact with a surface on which the instrument is placed thereby to support the shaft in a position in which a portion of the shaft is spaced away from the surface. The support is configured as a three-dimensional advertising image.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE DRAWINGS

Figure 3:
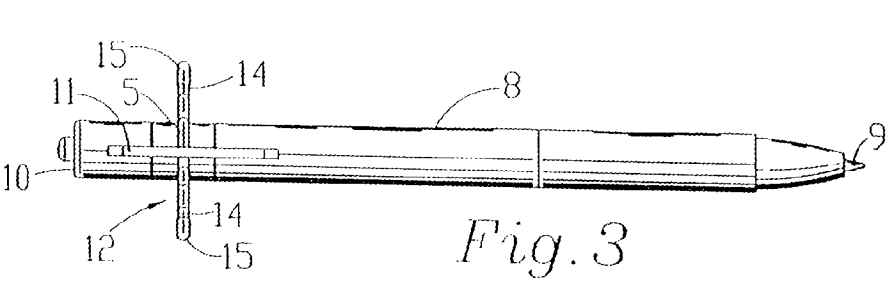
FIG. 3 is a top-plan view illustrating the writing instrument.
Figure 1:
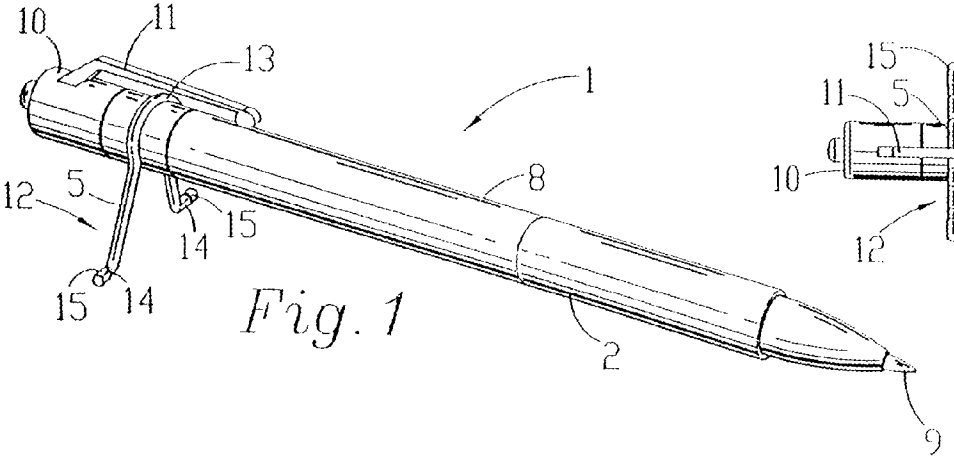
FIG. 1 is a perspective view illustrating a writing instrument with a support in accordance with the present invention.
Figure 4:
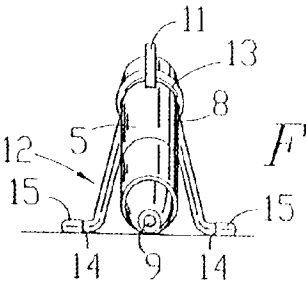
FIG. 4 is a front-elevational view illustrating the writing instrument.
Figure 2:
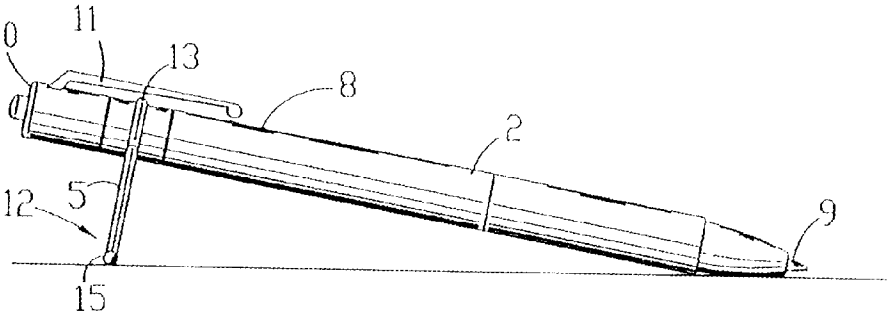
FIG. 2 is a side-elevational view illustrating the writing instrument.
Figure 5:
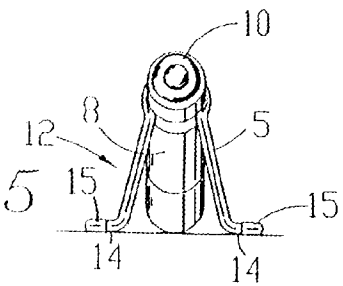
FIG. 5 is a rear-elevational view illustrating the writing instrument.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference number 1 generally represents a self-supporting coating instrument, more specifically, a fluid dispensing instrument, and more specifically still, a writing instrument in accordance with the present invention and as depicted in FIGS. 1-5. The writing instrument 1 primarily consists of an elongated body 2 and a detachable support 5 that are assembled after manufacture allowing for the detachable support 5 to be used with a number of different shaped bodies. The detachable support 5 engages the body 2 at one end of a shaft 8 opposite a writing end 9 (broadly, a coating tip) near a distal or rear end 10. The support 5 can be used in combination with a traditional pen clip 11, as shown and which are well-known in the art, so as to not detract from the operation and use of the clip 11.

In the preferred embodiment, the support 5 is constructed of an elongated wire, but it is foreseen that another like material such as plastic can be utilized providing that the material properties include sufficient resiliency and memory to be able to flex and spring around a shaft of a coating instrument and snap back and return to its original configuration at a central C-shaped region sized and shaped to snugly surround the shaft.

The detachable support has legs 12 extending outward from the C-shaped region 13. The legs 12 are spaced in relationship with one another and diverge outwardly away from the body 2 to provide a triangular support system to the writing instrument 1. The C-shaped region 13 is designed to receive various shafts having a common or conventional width that are found among writing instruments 1, which is approximately ⅜ inches diameter. The C-shaped region 13 is designed to engage the shaft 8 by flexing outward and then snapping around the shaft 8.

It is foreseen that a support could utilize a number of designs such as a single relatively wide leg or a single leg with a relatively wide base having a V shape (FIG. 12A) or U shape. Also foreseen is a support that is connected to a writing instrument cap, which can be selectively placed on either end of a writing instrument shaft having a support that provides sufficient stability for the intended supporting function of the present invention.

At the lower or distal end of each leg 12 is an outwardly extending foot 14. Located on ends of each foot 14 are rubber or plastic balls or pads 15 to provide friction on a non-slip surface upon engagement with a horizontal surface or something of the like and to prevent the support 5 from scratching the horizontal surface. While it is foreseen that a number of other materials could be utilized to form the pads 15, the pads 15 are ideally manufactured by dipping the tips of the legs 12 into liquid polyurethane.

The writing instrument 1 is especially advantageous for use in applications requiring a plethora of different liquids of various colors, viscosities and textures, along with different marking or fluid dispensing tips, etc., which require a user to sporadically switch back and forth between the liquids and tips during operation. While archaic instruments, which are designed to be laid flat on a table or the like, would require the user to shake the instrument to bias the liquid toward the marking end of the instrument when use is desired, the present invention provides the user with writing instruments 1 that are readily useable. Although the illustrated coating instrument is a writing instrument 1 for dispensing ink, other types of coating instruments, including other types of writing instruments, such as pencils and markers, are within the scope of the present invention. The coating instrument of the present invention may be designed to dispense fluid medication, such as medication for treating ailments of the skin. Moreover, the coating instrument may be an X-ray marker for marking on a radiograph or a marker for writing on a patient's skin. Other types of coating instruments are within the scope of the present invention.

Furthermore, if the user is operating on a surface that is not horizontal, such as an architect's desk, the present invention provides the user with coating instruments that can be secured in one position, thus preventing undesired migration of the instrument across the surface.

In a second embodiment as depicted in FIGS. 6-12, a hinged, self-supporting writing instrument 101 has an elongated shaft 108 with a fluid dispensing or writing tip or end 110 at one extremity of the shaft 108. Within the shaft 108 is a coating or liquid reservoir 109 that flow-communicates with the writing end 110.

Figures 6, 7, 8, 9, 10, 11, 12:
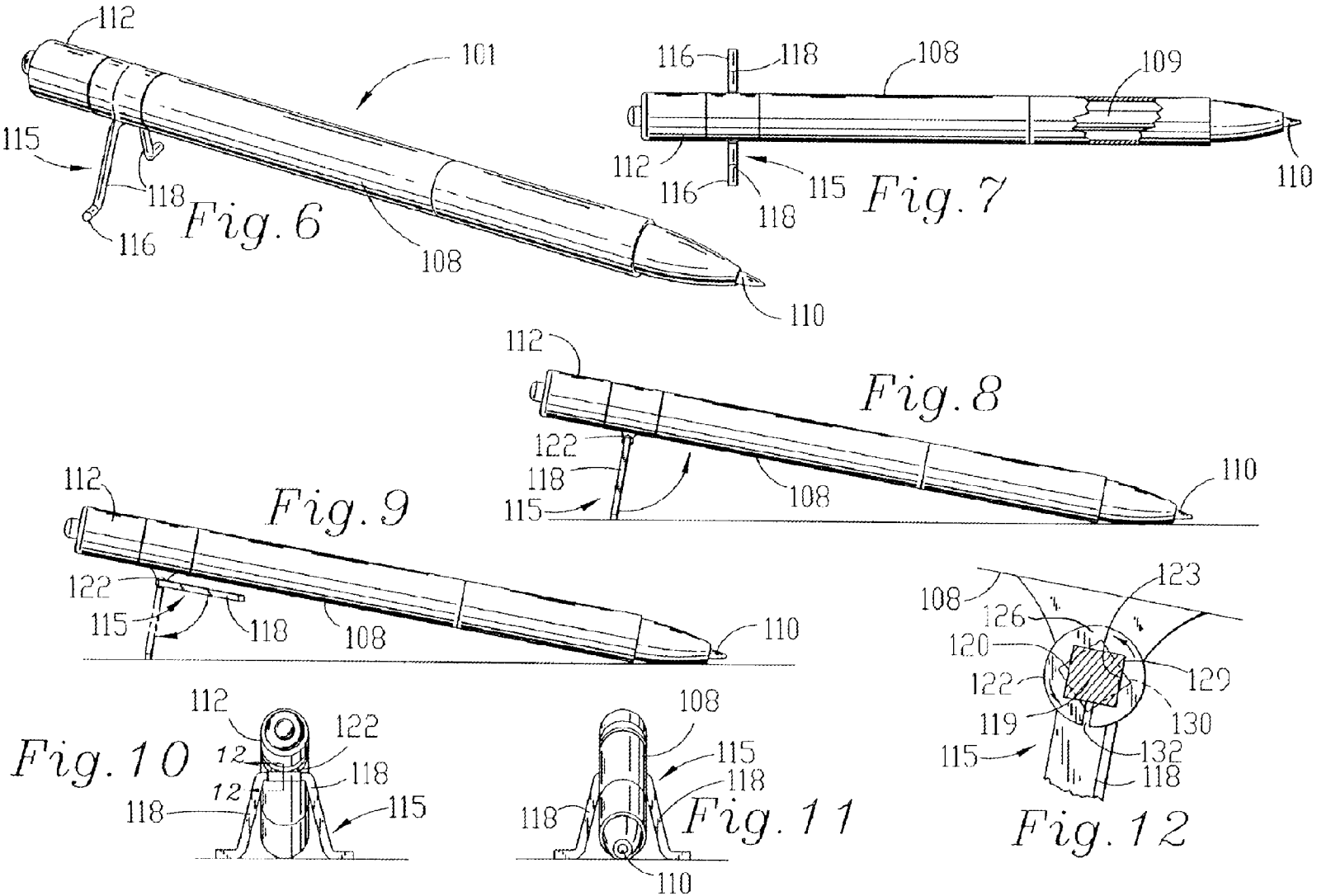
FIG. 6 is a perspective view illustrating a second embodiment of a writing instrument according to the present invention having a support shown in a use or supporting configuration.
FIG. 7 is a top-plan view illustrating the second embodiment of the writing instrument in the use configuration with a portion broken away to show a fluid reservoir.
FIG. 8 is a side-elevational view illustrating the second embodiment of the writing instrument in the use configuration.
FIG. 9 is a side-elevational view illustrating the second embodiment of the writing instrument in a stored configuration in solid lines and in the use configuration in phantom lines.
FIG. 10 is a rear-elevational view illustrating the second embodiment of the writing instrument in the use configuration.
FIG. 11 is a front-elevational view illustrating the second embodiment of the writing instrument in the use configuration.
FIG. 12 is an enlarged cross-sectional view, taken along 12-12 of FIG. 10, illustrating a hinge and keeper of the second embodiment of the writing instrument with the support in the use configuration.

Opposite the writing end 110 of the shaft 108 near a distal or rear end 112 is a support 115. In the present embodiment, the support 115 is integrated with or pivotally joined to the shaft 108 during manufacture of the writing instrument 101. The support 115 has legs 118 joined by a bar 119 having shaft-engagement surface 120. At the lower or distal end of each leg 118 is an outwardly extending foot 116. As depicted in FIG. 12, the bar 119 is square in cross section and is attached to the distal end 112 of the shaft 108 via a flexible keeper 122, having an interior surface 123 that is snugly mateable with the bar 119 when in a relaxed configuration. The keeper 122 is flexible and can be biased to a stretched configuration by applying manual pressure rotational to the support 115. In this manner, the bar 119 rotates in the keeper 122 between a first stable position seen in FIG. 9 in solid lines wherein the support 115 is in a non-extended position and a second stable position seen in FIG. 9 in phantom lines wherein the support 115 is in an extended and supporting position. The keeper 122 springs or flexes outwardly under pressure to allow the support 115 to move between the position described, but returns to snugly cradle the support 115 in a desired position, once that position is obtained. In particular, the keeper 122 allows the legs 118 to pivot away from and alternatively toward the shaft 108 in order to alternate from a stored configuration to a use configuration. In the use configuration, the support legs 118 extend or pivot away from the shaft 108 to a preselected angle such as ninety degrees in order to form a tripod configuration with the coating end 110.

It is foreseen that the keeper 122 forming a hinge with the bar 119 could be constructed with a clip that goes around a shaft so that a leg or legs may pivot relative to the shaft. It is also foreseen that the keeper 122 forming a hinge, as depicted in FIG. 9, could be located on the opposite side of a shaft so that when converting from a storage to a use configuration, a leg or legs pivot toward and straddle the shaft as opposed to away from the shaft as depicted in FIG. 9. In either instance, the clip and/or legs would flex and spring around a shaft and snap back and return to its original configuration or may be more rigid and slide along the shaft from one end thereof into a desired locator. Where resistance is required, the support may be constructed of a material that is sufficiently resilient and has memory.

In the use configuration, as depicted in FIG. 8, the writing instrument 101 can be placed on a horizontal surface while the distal end 112 is propped upward within easy grasp of a user and an interior reservoir 109, located within the shaft 108 as depicted in FIG. 7, is extended upwardly above the writing end 110, thus utilizing gravity to bias the fluid contents of the reservoir 109 toward the marking end 110 of the instrument 101 to provide an instrument 101 that is readily graspable and useable. In the stored position, as depicted in solid lines in FIG. 9, the legs 118 pivot to extend alongside and generally parallel to the reservoir 109 and shaft 108 at a preselected angle, such as zero degrees. The present embodiment provides space between the shaft 108 and the legs 118 in order to allow the legs 118 to act as a traditional pen clip. However, it is foreseen that in some embodiments, that a support could be provided that is flush mounted to a shaft with the shaft having an outer surface that corresponds to the support with the support designed to fold outward.

In either configuration, the writing instrument 101 is designed to provide two stabilized positions at a selected angular configuration with respect to the shaft 108. While it is foreseen that stabilization can be achieved with a number of designs, the present embodiment utilizes a spring-loaded outward C-shaped member 126 with the interior surface 123 that engages the bar 119 and is located within the keeper 122, as depicted in FIG. 12. The bar 119 has a rectangular surface 129 that matingly engages and aligns with a corresponding mating surface 130 of the keeper interior surface 126. The surfaces 129 and 130 have sufficient resiliency so that the support surface 129 can rotate within the mating surface 130 with the application of force. Specifically, the application of pressure overcomes and biases out the keeper 126 allowing rotation of the bar 119 and pivoting of the legs 118. A flex channel 132 is located within the keeper 122. The bar 119 is initially inserted in the keeper 122 by forcibly spreading opposites sides thereof at the flex channel 132 and urging the bar 119 therethrough.

Figure 12A:
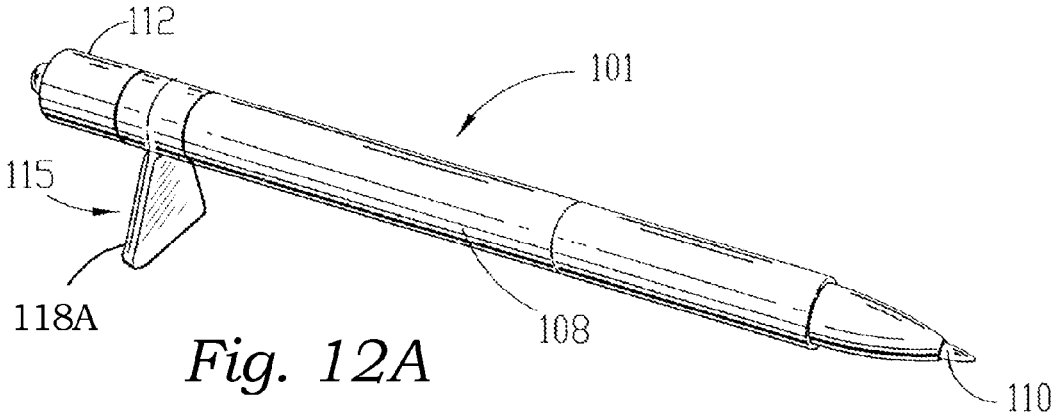
FIG. 12A is a perspective view illustrating another example of the second embodiment of the writing instrument of the present invention.

Referring to FIG. 12A, in another example of the second embodiment of the writing instrument 101, the support 115 comprises a single leg 118A with a relatively wide base having a V shape. The use and function of the single leg 118A is similar to the use and function of the pair of legs 118 depicted in FIGS. 6-12 and described above.

Figures 13, 14, 15, 16, 17, 18, 19, 20, 21:
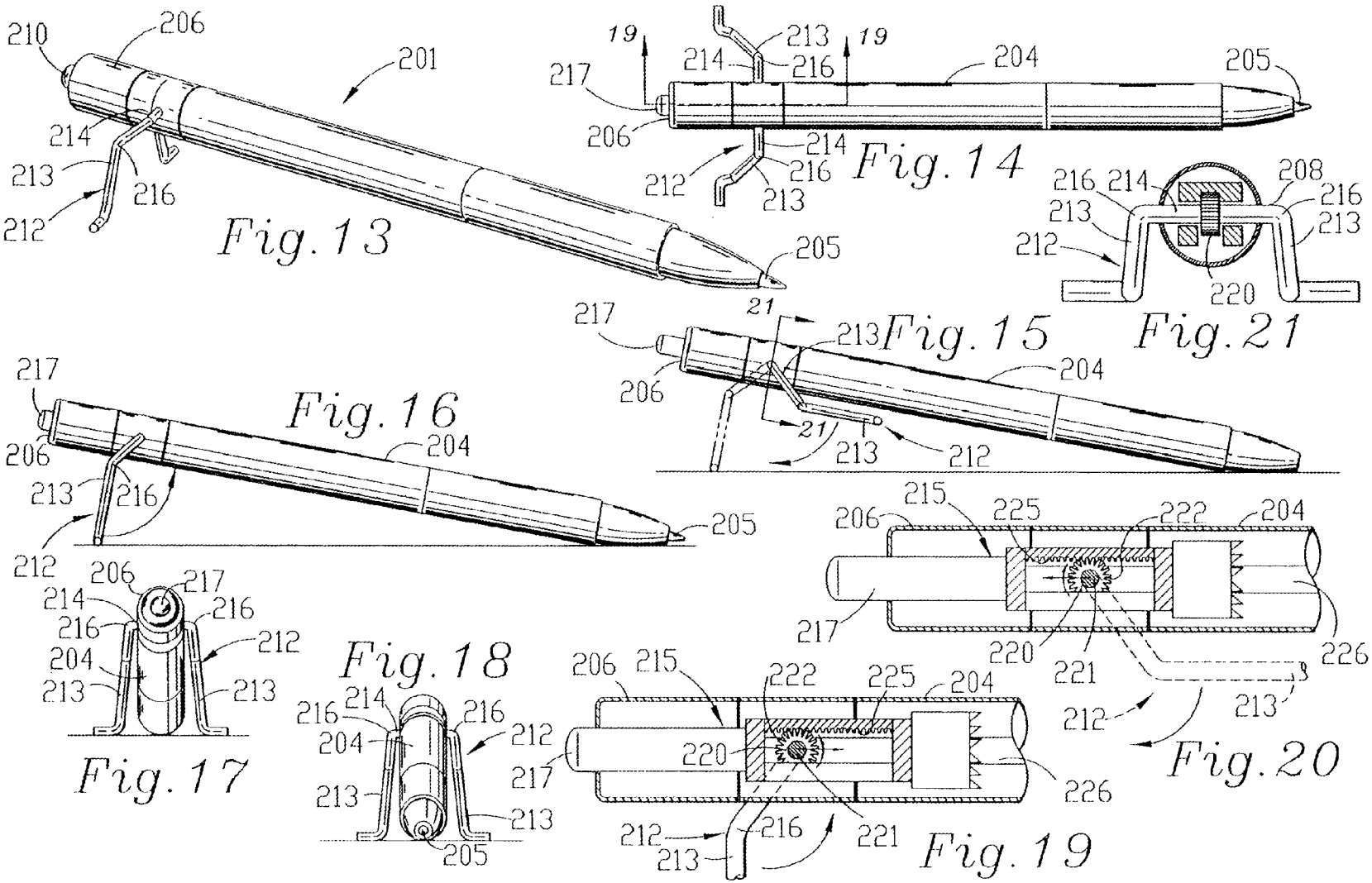
FIG. 13 is a perspective view illustrating a third embodiment of a writing instrument according to the present invention in a use configuration.
FIG. 14 is a top-plan view illustrating the third embodiment of the writing instrument in the use configuration.
FIG. 15 is a side-elevational view illustrating the third embodiment of the writing instrument in a stored configuration.
FIG. 16 is a side-elevational view illustrating the third embodiment of the writing instrument in the use configuration.
FIG. 17 is a rear-elevational view illustrating the third embodiment of the writing instrument in the use configuration.
FIG. 18 is a front-elevational view illustrating the third embodiment of the writing instrument in the use configuration.
FIG. 19 is an enlarged cross-sectional view, taken along 19-19, of FIG. 14, illustrating a rack and pinion gear system of the third embodiment of the writing instrument with the support in a use configuration.
FIG. 20 is an enlarged cross-sectional view, taken along 19-19 illustrating the rack and pinion gear system of the third embodiment of the writing instrument with the support in a stored configuration.
FIG. 21 is an enlarged cross-sectional view, taken along 21-21 of FIG. 15, illustrating a rear view of the rack and pinion gear system of the third embodiment of the writing instrument with the support in a stored configuration.
Figure 22:
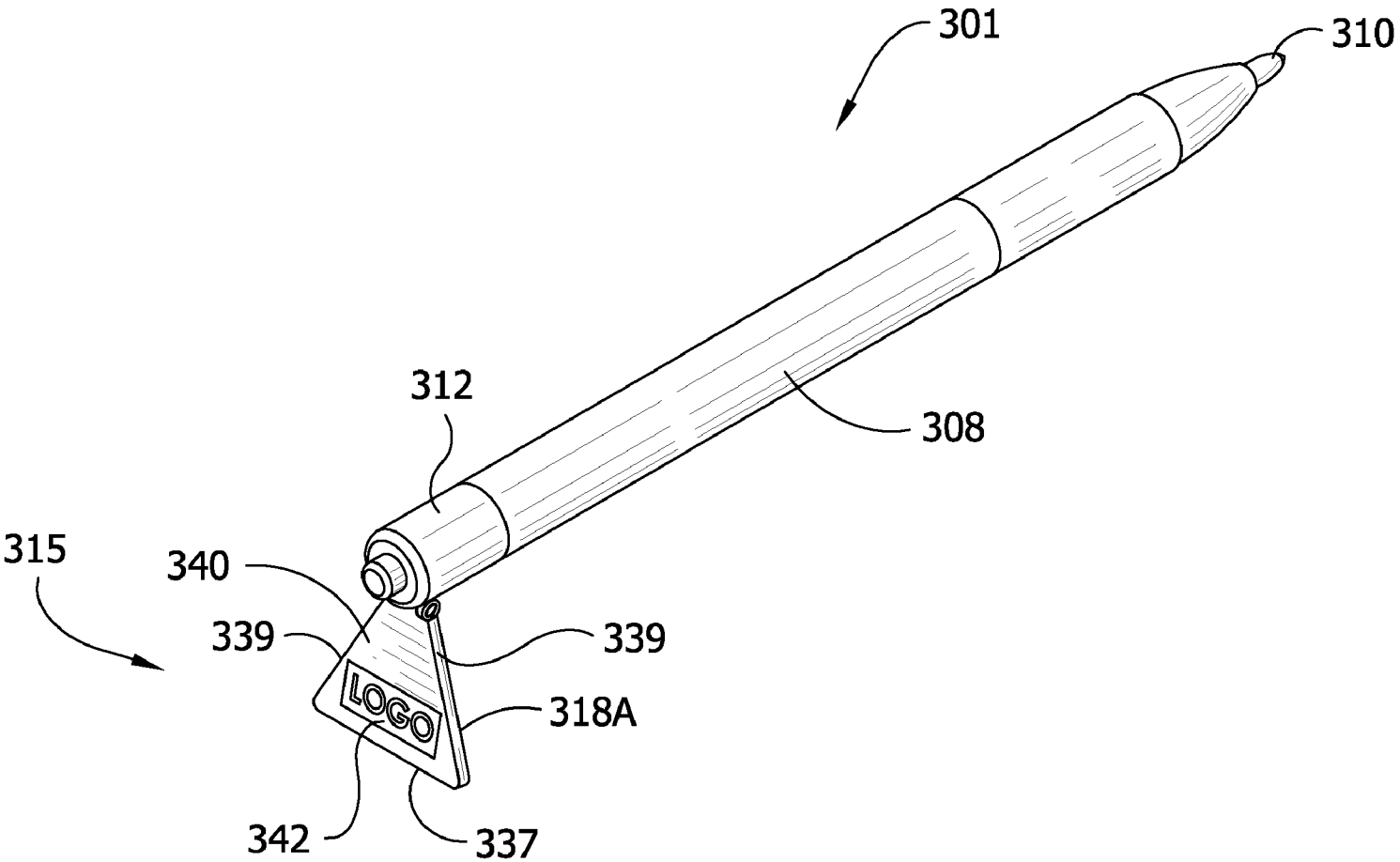
FIG. 22 is a perspective of another embodiment of the writing instrument with a support of the writing instrument in its extended position.
Figure 23:
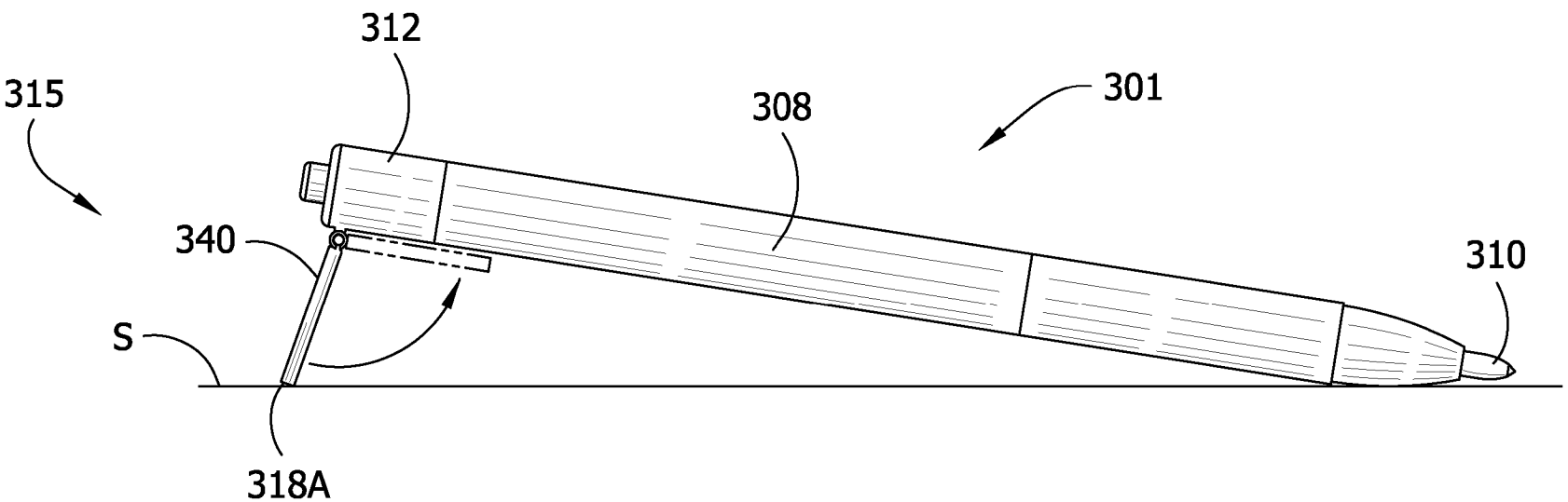
FIG. 23 is a side-elevational view of the writing instrument with the support in its extended position.
Figure 24:
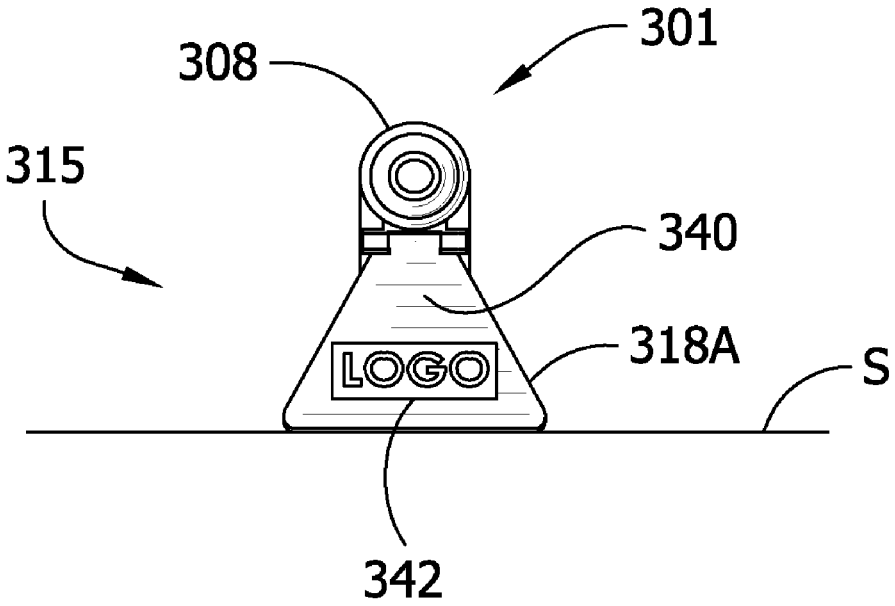
FIG. 24 is a rear-elevational view of the writing instrument with the support in its extended position.

A third embodiment, depicted in FIGS. 13-21, consists of an integrated, writing instrument 201 which is a push-button actuated pen having an elongated shaft 204 and a marking or writing end 205 that is opposite a distal or rear end 206. The present embodiment has a support 212 near the distal end 206 with legs 213 and a cross bar 214 spacing and connecting the legs 213. Each of the legs 213 is bent at an elbow 216, so as to operably space the lower portion of the legs 213 near and parallel but away from the shaft 204 in a stored configuration such as is seen in solid lines in FIG. 15. The bar 214 is integrated into and operates cooperatively with a push-button mechanism 215 for the instrument 201. Specifically, the instrument 201 operates by depressing a button 217 to either extend or retract a writing or marking tip 205. The present embodiment adds a pinion gear 220 with a center axis 221 within the shaft 204 near the distal end 206, as depicted in FIGS. 19-21, that cooperatively engages the bar 214 of the support 212. The bar 214 passes through the center axis 221 of the pinion gear 220. The pinion gear 220 has a toothed outer rim 222 that engages and a rack 225 that is operably located between the push button 217 and a fluid reservoir 226. As the push button 217 is operated, the rack 225 jogs back and forth toward rear and front within the shaft 204, which causes the pinion gear 220 to spin. The pinion gear 220 causes the bar 214 to rotate, which causes the legs 213 to pivot back and forth between the stored configuration, as depicted in FIG. 15, and a use configuration, as depicted in FIG. 16.

In the use configuration, the writing instrument 201 can be placed on a horizontal surface while the distal end 206 is propped upward within easy grasp of a user and the reservoir 226, which is located within the shaft 204, as depicted in FIGS. 19 and 20, is located above the writing end 205, thus utilizing gravity to bias the fluid contents of the reservoir 226 toward the writing end 205 of the instrument 201 so that the instrument 201 is both readily graspable and immediately useable.

In the stored position, as depicted in FIG. 15, the legs 213 pivot so as to extend alongside and parallel to the shaft 204 so that the legs 213 of the support 212 may be used as a traditional pen clip for holding in a pocket or the like. Further, the legs 213 are swept backwards at an angle to provide a traditional pen clip function when the support 212 is in the stored configuration.

In either configuration, the self-supporting writing instrument 201 is designed to provide two stabilized positions at selected angular locations relative to the shaft 204.

Referring to FIGS. 22-25, another embodiment of the writing instrument, generally indicated at 301 is similar to the embodiments illustrated in FIGS. 6-12A, and therefore, like components are indicated by corresponding reference numerals plus 200. The present embodiment is most similar to the embodiment in FIG. 12A in that the writing instrument includes a support 315 comprising a single leg 318A having a relatively wide base 337 and tapered side edges 339. The support 315 is pivotally secured adjacent to a rear end 312 of the shaft 308 of the writing instrument 301 in a manner similar to that taught by the embodiments illustrated in FIGS. 6-12A. It is understood that the support 315 may be pivotally secured or pivotally securable to the writing instrument 301 in other ways, including the ways taught by the other embodiments of the present invention. Like the support 115 in FIG. 12A, the present support 315 is movable between an extended position, in which the support projects outward away from the shaft 308 for contact with a surface S on which the instrument is placed (FIGS. 23 and 24), and a non-extended position (FIG. 25), in which the support can function as a traditional clip for attaching the writing instrument to a pocket, for example. In the illustrated embodiment, when the support 315 is in the extended position and is contacting the surface S to support the writing instrument, the writing or fluid dispensing tip 310 and a portion of the shaft 308 are spaced from the surface.

An outer, generally planar face 340 of the support 315, which faces away from the shaft 308 of the writing instrument 301 when the support is in its non-extended position, includes an advertising image 342 that is imprinted or formed on or otherwise affixed to it. For example, the advertising image 342 may be a computer generated image that is created on a substrate with an adhesive backing that is adhered to the support 315. Alternatively, the advertising image 342 may be formed (e.g., molded) directly on the support 315. Other ways of affixing or forming the image 342 are within the scope of the invention. It is understood that the support may be of a shape or type other than a solid, generally triangular member. For example, the support can comprise a pair of collapsible legs, and the advertising image can be affixed to or otherwise formed on a pliable substrate extending between the collapsible legs so that when the legs are in the non-extended position, the advertising image faces outward away from the shaft. In another example, the pliable substrate on which the advertising image is disposed can have an end secured to an end of the support and an opposite end secured to the shaft of the writing instrument so that when the support is in the non-extended position, the advertising image faces outward away from the shaft. Other types of supports and other ways of disposing the advertising image on the support are within the scope of the invention.

Figure 25:
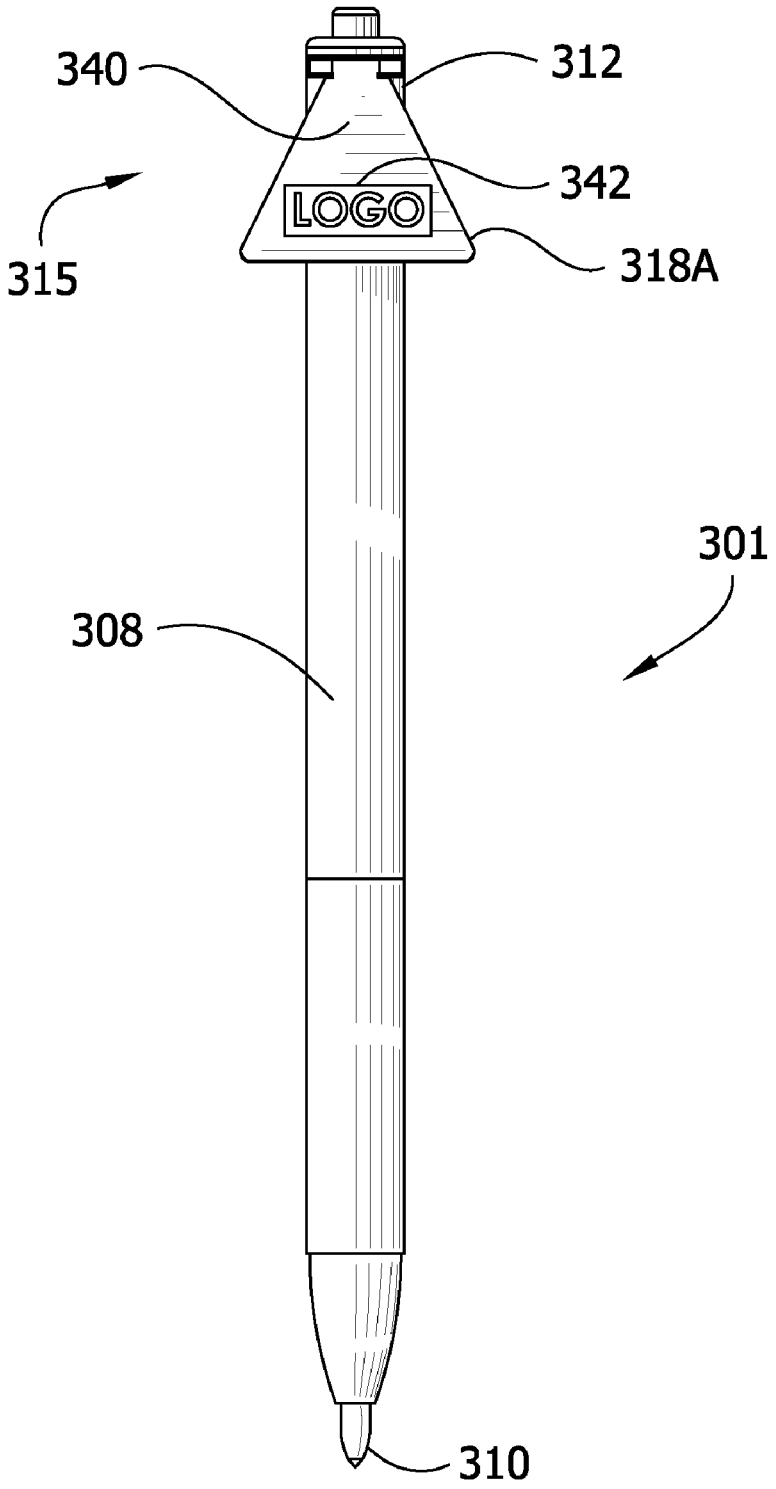
FIG. 25 is an elevational view of the writing instrument with the support in its non-extended position.
Figure 26:
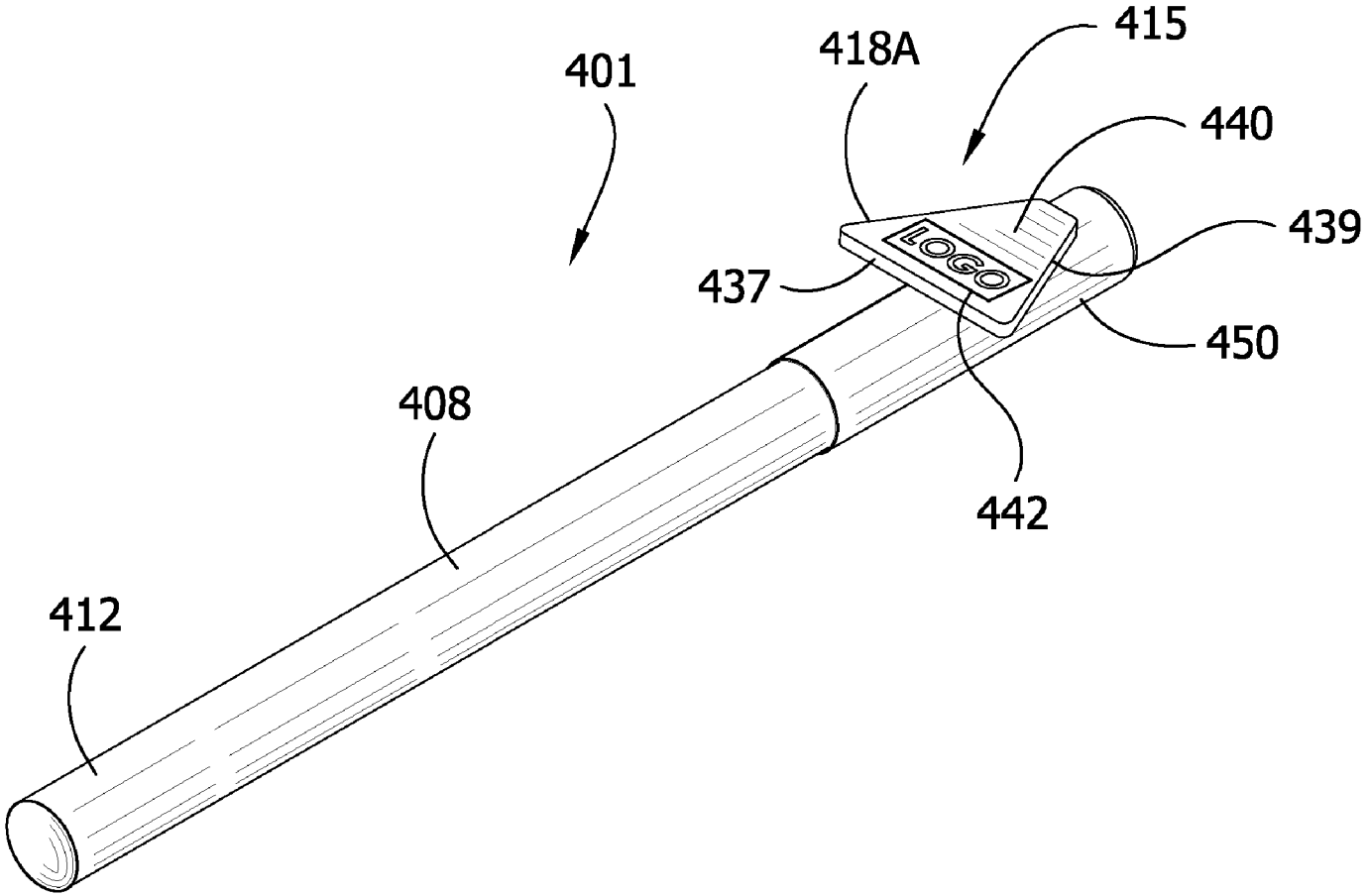
FIG. 26 is a perspective of another embodiment of the writing instrument illustrating a support of the writing instrument secured to a cap of the instrument and in its non-extended position.
Figure 27:
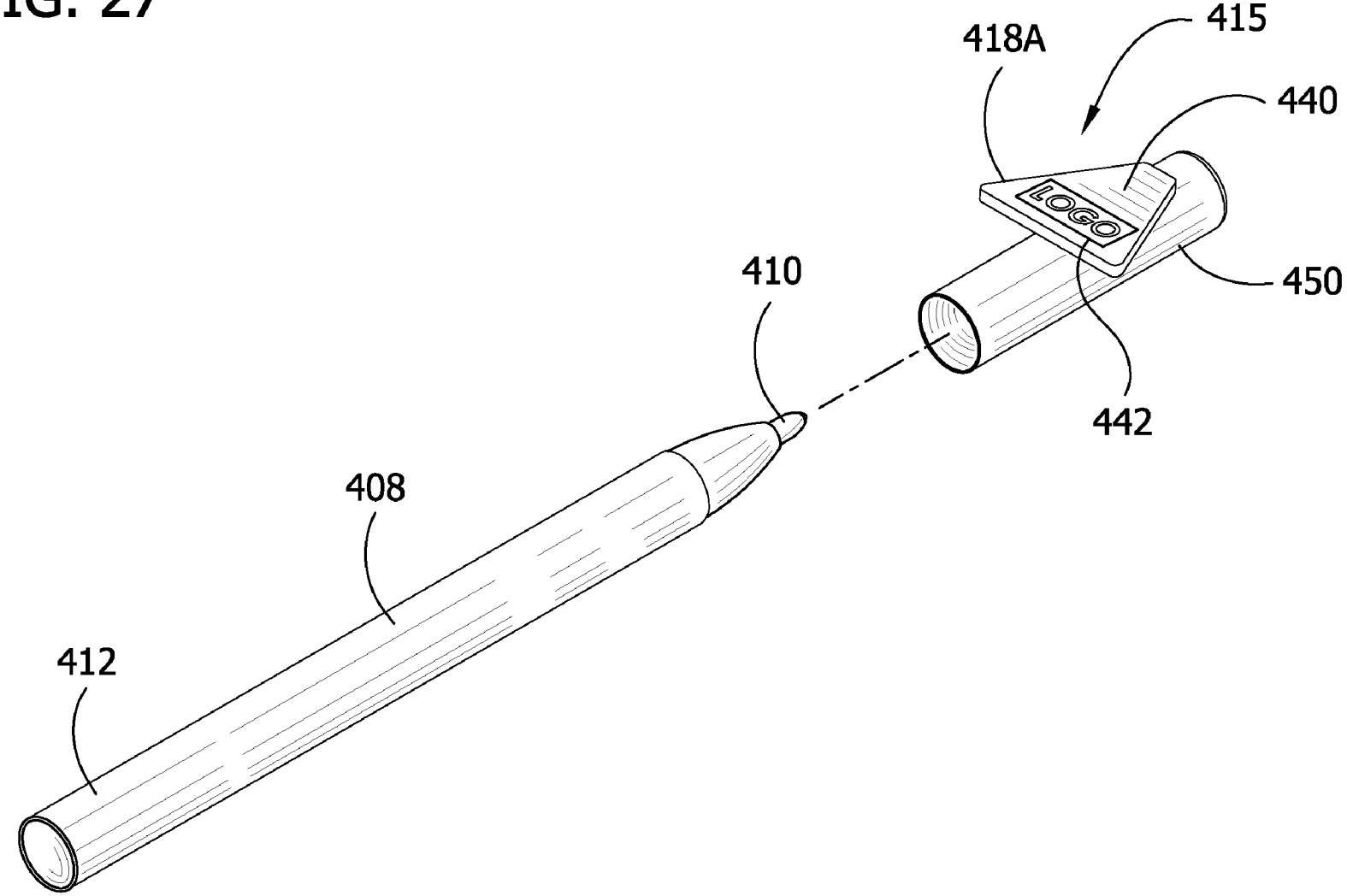
FIG. 27 is similar to FIG. 26 with the cap of the writing instrument exploded from a shaft of the writing instrument.

In the illustrated embodiment, the advertising image 342 is a graphic image of a logo of a company or organization. It is understood that the advertising image 342 may comprise one or more of a logo, motto, trademark, trade name or any other type of advertising and/or marketing of a company or organization. As is readily apparent from the drawings, the advertising image 342 on the outer face 340 of the support 315 is readily visible whether the support is in its extended position and contacting a surface S to support the writing instrument 301 (FIGS. 22 and 24) or its non-extended position (FIG. 25).

Figure 28:
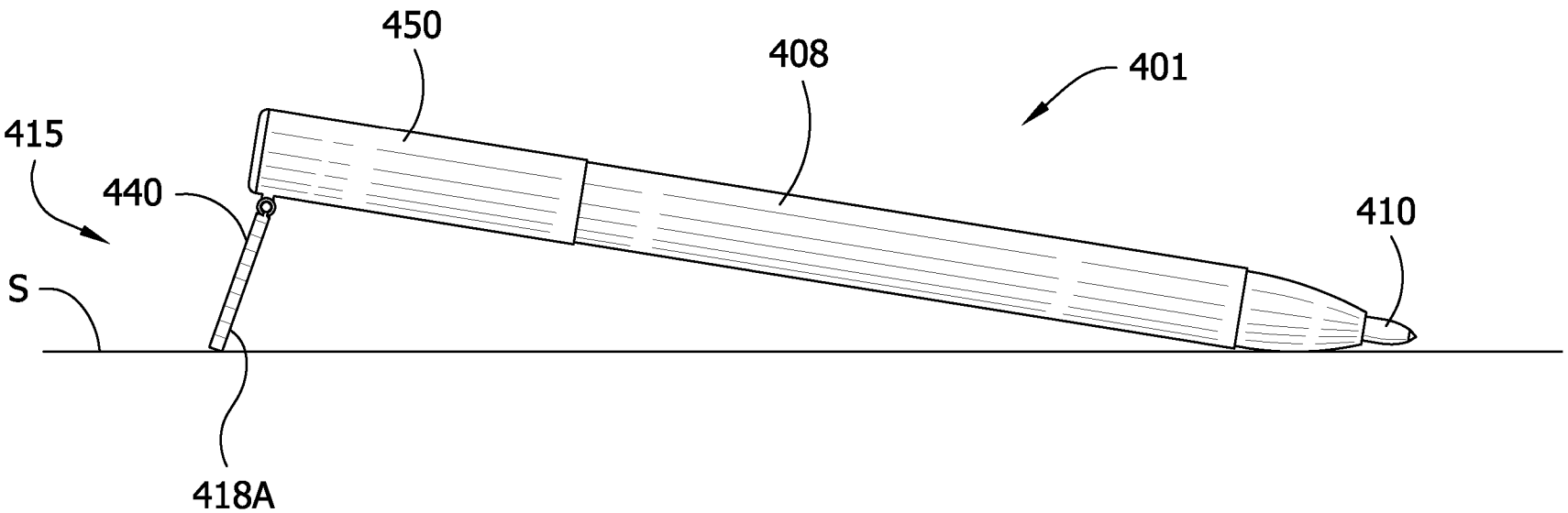
FIG. 28 is a side-elevational view illustrating the cap secured to a rear end of the writing instrument and the support in its extended position.
Figure 29:
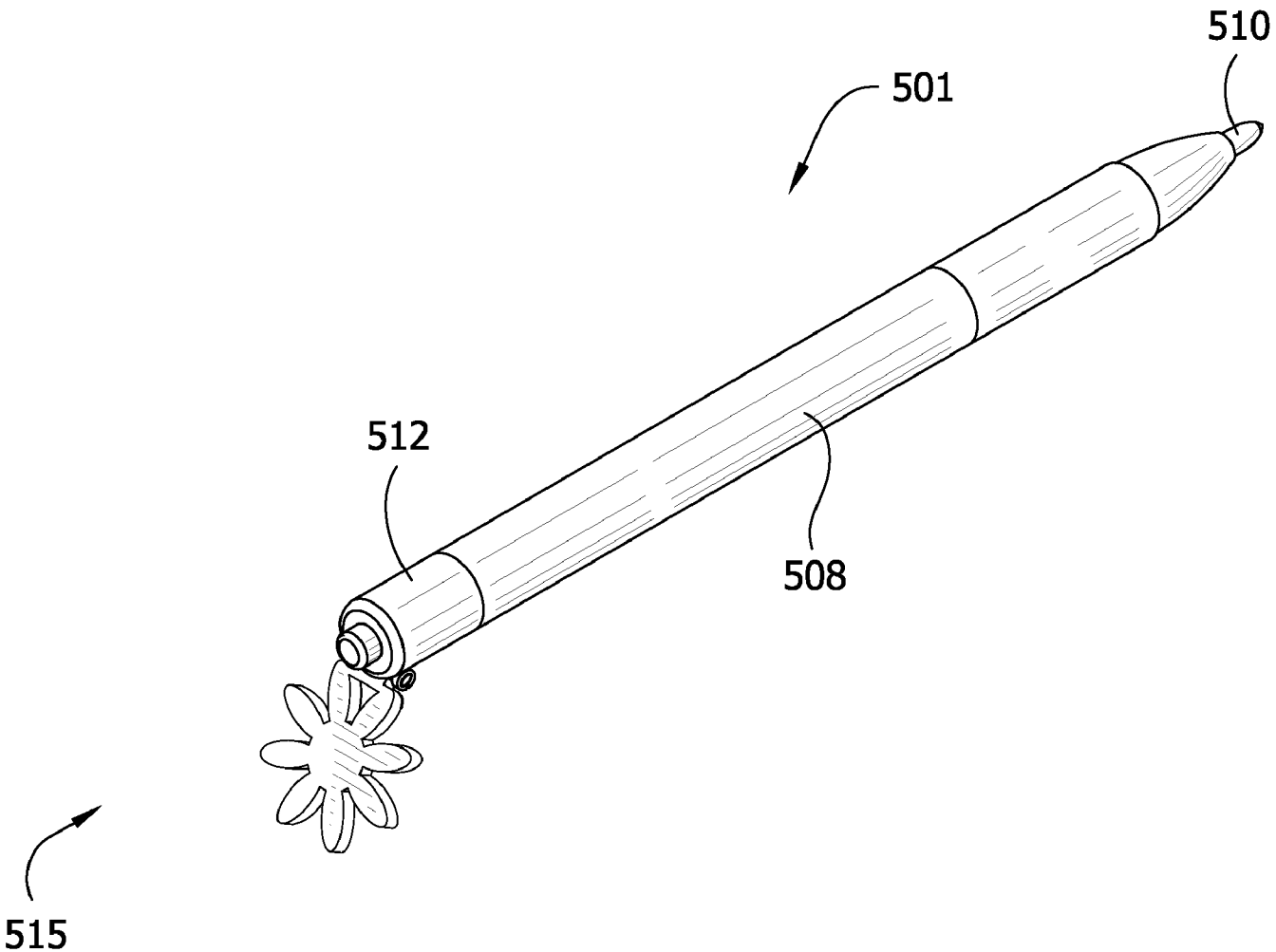
FIG. 29 is a perspective of another embodiment of the writing instrument with a support of the writing instrument in its extended position.
Figure 30:
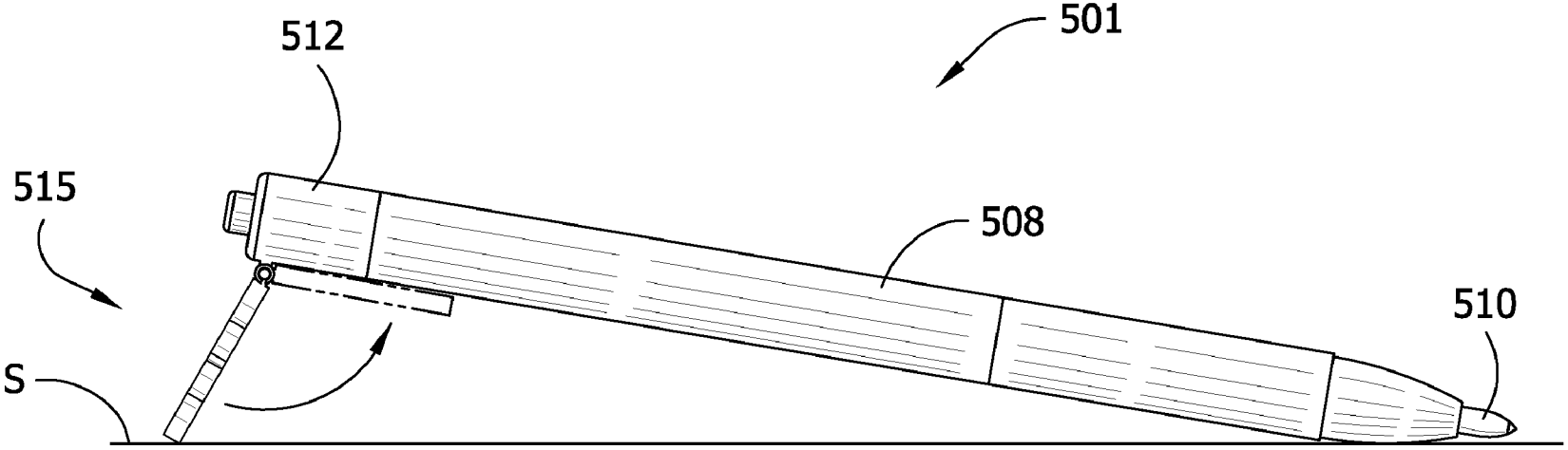
FIG. 30 is a side-elevational view of the writing instrument with the support in its extended position.
Figure 31:
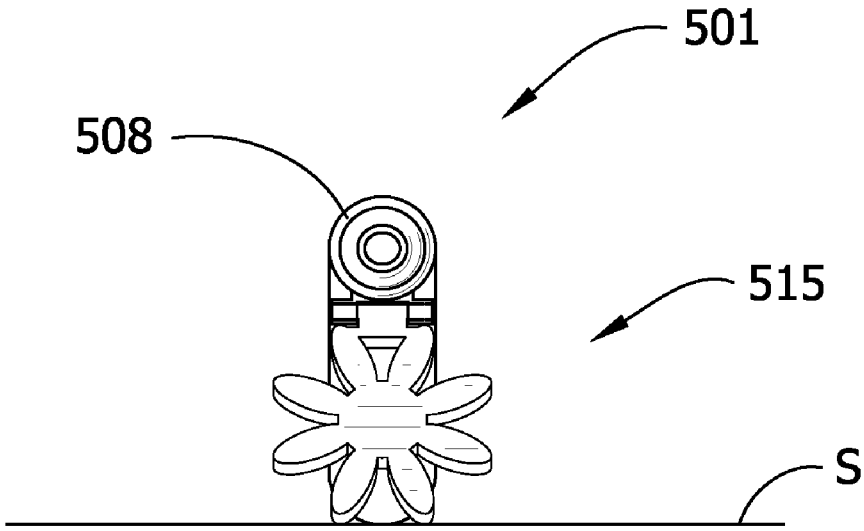
FIG. 31 is a rear-elevational view of the writing instrument with the support in its extended position.
Figure 32:
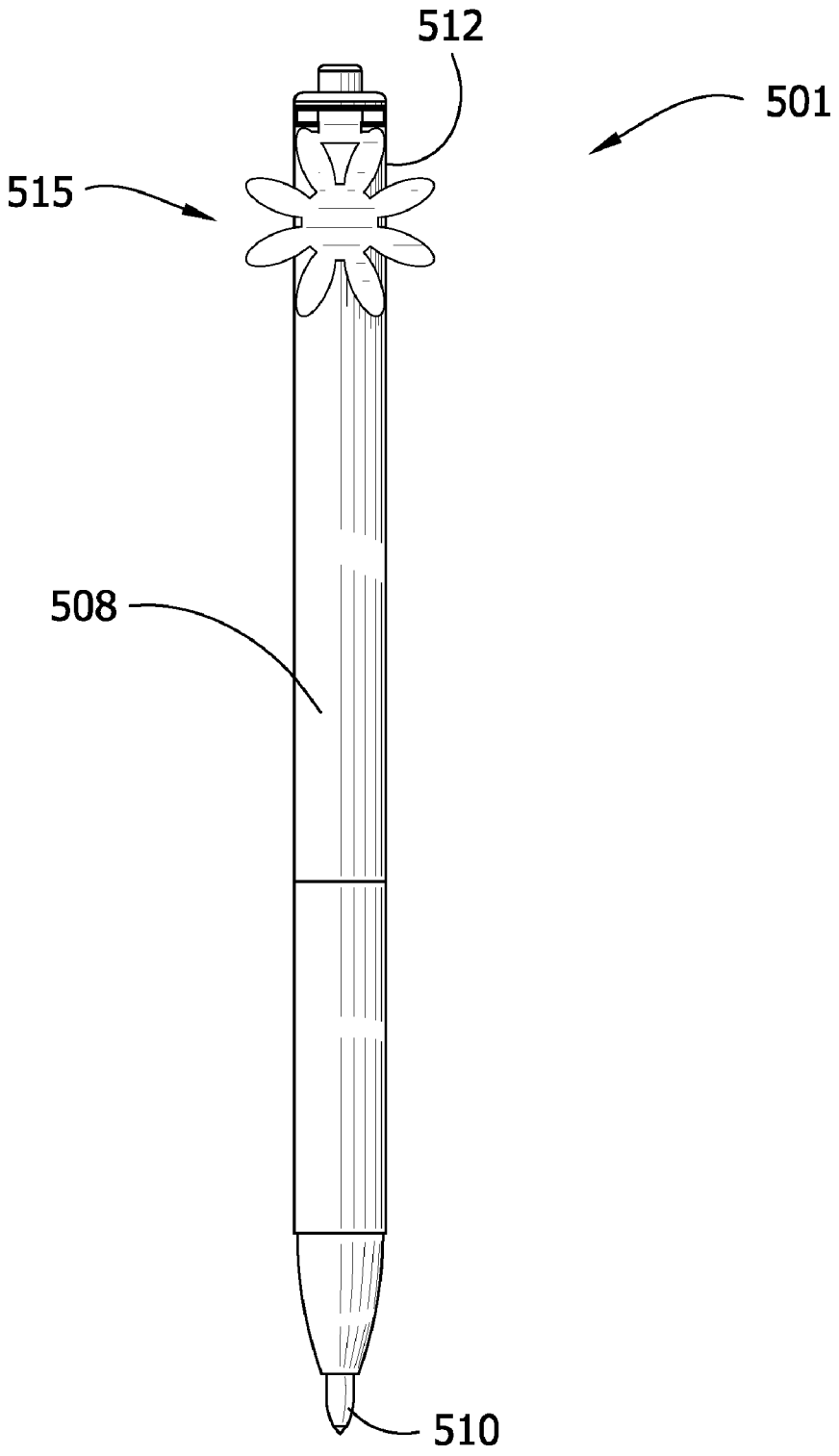
FIG. 32 is an elevational view of the writing instrument with the support in its non-extended position.

Referring to FIGS. 26-29, in another embodiment that is similar to the embodiment of FIGS. 22-25 and has like components indicated by corresponding reference numerals plus 100, the writing instrument 401 includes a support 415 that is pivotally secured to a cap 450 of the writing instrument. The cap 450 is removably securable to the writing end of the writing instrument over the writing tip (FIGS. 26 and 27) and is removably securable over the rear end 412 of the instrument (FIG. 28). Thus, when the cap 450 is secured over the tip 410 of the writing instrument 401 (FIG. 26), the support 415 may be positioned in its non-extended position and may operate as a clip with the advertising image 442 being readily visible. Moreover, referring to FIG. 28, when the cap 450 is removed from the writing end and received on the opposite, rear end 412 of the writing instrument 401, the support 415 may be positioned in its extended position whereby the writing instrument can be placed on the surface S so that the support contacts the surface to support the shaft 408 in a position in which a portion of the shaft is spaced away from the surface. The advertising image 442 is readily visible when viewing the writing instrument from the rear.

Referring to FIGS. 29-32, in yet another embodiment that is similar to the embodiment of FIGS. 22-25 and has like components indicated by corresponding reference numerals plus 200, the writing instrument 501 includes a support 515 that is formed as the advertising image. In this embodiment, the periphery of the support 515 may be coincident with the periphery of the advertising image and/or the support may take the three-dimensional form of the advertising image. Moreover, the outer face of the support may not be planar so as to further define contours of a three-dimensional image. In the illustrated embodiment, the support 515 is formed as a three-dimensional asterisk, representing a logo of a company. Although the illustrated support 515 is pivotally secured to the shaft 508 of the writing instrument 501, it is understood that it may be secured to other components of the writing instrument, such as a cap, similar to the embodiment of FIGS. 26-28. Moreover, although the support 515 is pivotally secured to the shaft 508 in a similar manner as shown in FIGS. 6-12A, it is understood that it may be secured to the shaft or cap or other component of the writing instrument in other ways without departing from the scope of the invention.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A coating instrument comprising:

a shaft having opposite front and rear ends;

a coating tip adjacent to the front end of the shaft;

a liquid reservoir contained within the shaft, wherein the liquid reservoir is in communication with the coating tip;

a support securable to the shaft and spaced from the coating tip whereby the support does not cover either of the ends of the shaft when the support is secured to the shaft, the support being movable with respect to the shaft from a non-extended position to an extended position in which the support projects outward away from the shaft for contact with a surface on which the instrument is placed thereby to support the shaft in a position in which a portion of the shaft is spaced away from the surface in a substantially downward position wherein the shaft slopes down toward the coating tip; and an advertising image on the support facing outward away from the shaft when the support is in said non-extended position.

2. A coating instrument as set forth in claim 1 wherein the advertising image comprises at least one of a logo, a motto, a trademark, and a trade name of a company or organization.

3. A coating instrument as set forth in claim 2 wherein the support has an outer face generally facing away from the shaft in the non-extended position, said advertising image comprising a graphic image on a substrate affixed to said outer face of the support.

4. A coating instrument as set forth in claim 2 wherein the support has an outer face generally facing away from the shaft in the non-extended position, said advertising image being formed on said outer face of the support.

5. A coating instrument as set forth in claim 4 wherein the advertising image is molded on said outer face of the support.

6. A coating instrument as set forth in claim 5 wherein the support has a periphery generally coincident with the periphery of the advertising image.

7. A coating instrument as set forth in claim 1, further comprising a cap adapted to be removably secured to the front end of the shaft over the coating tip and to be removably secured over the rear end of the shaft, wherein the support is pivotally secured to the cap.

8. A coating instrument as set forth in claim 7, wherein the cap comprises an open end and a closed end and the support is pivotally secured to the cap adjacent the closed end.

9. A coating instrument as set forth in claim 8, wherein the support and the cap form an obtuse angle when the cap is removably secured to the rear end of the shaft with the support in the extended position, wherein the shaft slopes down toward the writing tip when the instrument is placed on the surface.

10. A coating instrument as set forth in claim 1 wherein the coating instrument is a fluid dispensing instrument including a reservoir for holding fluid to be dispensed from the instrument.

11. A coating instrument as set forth in claim 10 wherein the instrument is a pen for dispensing ink from the reservoir.

12. A coating instrument as set forth in claim 10 wherein the coating instrument is adapted for dispensing fluid medication from the reservoir onto an area of skin of a person.

13. A coating instrument as set forth in claim 1 wherein the coating instrument is a pencil.

14. A fluid dispensing instrument comprising:

a shaft having opposite front and rear ends;

a fluid dispensing tip adjacent to the front end of the shaft;

a cap adapted to be removably secured to the front end of the shaft over the fluid dispensing tip and to be removably secured over the rear end of the shaft, wherein the cap comprises an open end and a closed end; and a support pivotally secured to the cap adjacent the closed end and movable with respect to the shaft from a non-extended position to an extended position in which the support projects outward away from the shaft for contact with a surface on which the instrument is placed thereby to support the shaft in a position in which a portion of the shaft is spaced away from the surface, the support being configured as a three-dimensional advertising image;

wherein the shaft slopes down toward the writing tip in a substantially downward position when the instrument is placed on the surface with the cap covering the rear end of the shaft with the support in the extended position.

15. A fluid dispensing instrument as set forth in claim 14 wherein the support is formed as at least one of a logo, a motto, a trademark, and a trade name of a company or organization.

16. A coating instrument as set forth in claim 14, wherein the support and the cap form an obtuse angle when the support is in the extended position.

17. A coating instrument as set forth in claim 14, wherein the support and the cap form a right angle when the support is in the extended position.

18. A coating instrument as set forth in claim 1, wherein the support and the shaft form an obtuse angle when the support is in the extended position.

19. A coating instrument as set forth in claim 1, wherein the support is pivotally secured to the shaft adjacent the rear end and wherein the shaft slopes down toward the writing tip when the instrument is placed on the surface with the support in the extended position and the support and the shaft form an obtuse angle.

20. A coating instrument as set forth in claim 1, wherein the support and the shaft form a right angle when the support is in the extended position.

* * * * *